US007820098B2

(12) United States Patent
Morinaga et al.

(10) Patent No.: US 7,820,098 B2
(45) Date of Patent: Oct. 26, 2010

(54) HIGH CR FERRITIC HEAT RESISTANCE STEEL

(75) Inventors: Masahiko Morinaga, 10-28, Marunouchi 2-chome, Naka-ku, Nagoya-shi, Aichi 460-0002 (JP); Yoshinori Murata, 22, Sonoyama-cho 2-chome, Chikusa-ku, Nagoya-shi, Aichi 464-0812 (JP); Tsukasa Azuma, Muroran (JP); Kazuhiro Miki, Muroran (JP); Tohru Ishiguro, Muroran (JP); Ryokichi Hashizume, Osaka (JP)

(73) Assignees: The Japan Steel Works, Ltd. (JP); Masahiko Morinaga; Yoshinori Murata (JP); The Kansai Electric Power Co., Inc. (JP)

( * ) Notice: Subject to any disclaimer, the term of this patent is extended or adjusted under 35 U.S.C. 154(b) by 0 days.

(21) Appl. No.: 10/181,318

(22) PCT Filed: Aug. 16, 2001

(86) PCT No.: PCT/JP01/07056

§ 371 (c)(1),
(2), (4) Date: Jul. 16, 2002

(87) PCT Pub. No.: WO02/052056

PCT Pub. Date: Jul. 4, 2002

(65) Prior Publication Data

US 2003/0024609 A1 Feb. 6, 2003

(30) Foreign Application Priority Data

Dec. 26, 2000 (JP) ..... 2000-396014
Feb. 15, 2001 (JP) ..... 2001-038383

(51) Int. Cl.
*C22C 38/30* (2006.01)
*C22C 38/22* (2006.01)
*C22C 38/24* (2006.01)
*C22C 38/26* (2006.01)

(52) U.S. Cl. ..... 420/107; 420/37; 420/38; 420/39; 420/69; 420/113; 420/114

(58) Field of Classification Search ..... 148/325, 148/333–335, 327; 420/34–40, 83, 104–114, 420/56–58, 69
See application file for complete search history.

(56) References Cited

U.S. PATENT DOCUMENTS 5,061,440 A 10/1991 Watanabe et al.

(Continued)

FOREIGN PATENT DOCUMENTS

EP 38443 8/1990

(Continued)

OTHER PUBLICATIONS

Machine English translation of Japanese patent 409059746 , Mar. 4, 1997,Komai, Nobuyoshi et al.*

(Continued)

Primary Examiner—Deborah Yee
(74) *Attorney, Agent, or Firm*—Baker + Hostetler, LLP

(57) ABSTRACT

In the thermal power system, the electricity production efficiency may be improved by providing turbine members having the improved high temperature characteristic over the corresponding prior art turbine members. Turbine members may be provided by using high resistant steels composed of any one or ones selected from the group consisting of the components, including 0.08 to 0.13% of carbon (C), 8.5 to 9.8% of chromium (Cr), 0 to 1.5% of molybdenum (Mo), 0.10 to 0.25% of vanadium (V), 0.03 to 0.08% of niobium (Nb), 0.2 to 5.0% of tungsten (W), 1.5 to 6.0% of cobalt (Co), 0.002 to 0.015% of boron (B), 0.015 to 0.025% of nitrogen (N), and optionally, 0.01 to 3.0% of rhenium (Re), 0.1 to 0.50% of silicon (Si), 0.1 to 1.0% of manganese (Mo), 0.05 to 0.8% of nickel (Ni) and 0.1 to 1.3% of cupper. The long-time creep strength may be improved by using those high resistant steels for turbine rotors, turbine members and the like, which enable the steam temperature to be higher, thereby improving the electricity production efficiency in the thermal power system. The accelerated creep inhibitor parameter is provided for controlling the reduction in the creep strength so that the high creep strength can be maintained for the extended period of time.

4 Claims, 8 Drawing Sheets

U.S. PATENT DOCUMENTS

| | | | | | |
|---|---|---|---|---|---|
| 5,560,788 | A | * | 10/1996 | Yamada et al. | 148/326 |
| 5,888,318 | A | * | 3/1999 | Morinaga et al. | 148/500 |
| 5,961,284 | A | | 10/1999 | Kuriyama et al. | |
| 5,997,806 | A | * | 12/1999 | Fujita et al. | 420/38 |
| 6,174,385 | B1 | * | 1/2001 | Morinaga et al. | 148/325 |

FOREIGN PATENT DOCUMENTS

| | | | | |
|---|---|---|---|---|
| WO | WO 96/01334 | | | 1/1996 |
| EP | 384433 | | | 8/1990 |
| EP | 94305281 | | | 7/1994 |
| EP | 691416 | | | 1/1996 |
| EP | 767250 | | | 4/1997 |
| EP | 0 863 221 | A1 | | 9/1998 |
| EP | 0 976 844 | A2 | | 2/2000 |
| EP | 1 001 044 | A2 | | 5/2000 |
| JP | 60-165359 | | | 8/1985 |
| JP | 2-290950 | | | 11/1990 |
| JP | 4-147948 | | | 5/1992 |
| JP | 5-311342 | | | 11/1993 |
| JP | 7-278761 | | | 10/1995 |
| JP | 8-3697 | | | 1/1996 |
| JP | 8-296003 | | | 11/1996 |
| JP | 8-333657 | | | 12/1996 |
| JP | 9-59747 | | | 3/1997 |
| JP | 409059746 | | * | 3/1997 |
| JP | 09-184050 | | * | 7/1997 |
| JP | 10-88291 | | | 4/1998 |
| JP | 10-219403 | | | 8/1998 |
| JP | 11-92881 | | | 4/1999 |
| JP | 11-217655 | | | 8/1999 |
| JP | 2000-248337 | | | 9/2000 |

OTHER PUBLICATIONS

Metallurgy of stainless steels, "Residual Elements" p. 14-2, Materials Science in Engineering, second edition1980,Carl Keyer.*

Computer-generated English translation of Japanese patent 09-184050, Morinaga, Masahiko et al., Jul. 15, 1997.*

The Office action issued by the European Patent Office in the corresponding European patent application citing the above references.

ECCC Creep Conference, Sep. 12-14, 2005, London "Review of Allowable Stress and New guideline of Long-term Creep Strength Assessment for High Cr Ferritic Creep Resistant Steels" by Kazuhiro Kimura, Creep Group, Materials Information Technology Station, National Institute for Materials Science, Tsukaba, Japan (pp. 1009 to 1022).

Proceedings from the Fourth International Conference on Advances in Materials Technology for Fossil Power Plants, Oct. 25-28, 2004, Hilton Head Island, SC "Coarse Size BN Type Inclusions Formed in Boron Bearing High Cr Ferritic Heat Resistant Steel" by K. Sakuraya, et al, National Institute Tim Materials Science, Japan (pp. 1270 to 1279).

Materials for Advanced Power Engineering (2002), J. Lecomte-Beckers, M. Carton, et al; proceedings Part III, pp. 1497-1504.

Advances in Materials Technology for Fossil Power Plants (2004), Proceedings from the Fourth International conference Oct. 25-28, 2004, pp. 80-99.

17th International Forgemasters Meeting (2008), Santander, Spain Nov. 3-7, 2008, "Effect of CR on Change of Carbonitrides During Aging in High Cr Heat Resistant Steels".

The office action issued by the European Patent Office in the corresponding European patent application citing the above references, Nov. 29, 2005.

* cited by examiner

Creep Strain Rate – Time Curve
(Discontinous Acceleration)

As heat treatment
Photo 1 ( a )
1 μm

After creep rupture
Photo 1 ( b )
2 μm

As heat treatment
Photo 2 ( a )
1 μm

After creep rupture
Photo 2 ( b )
1 μm

Effect of Cr Content on Hardness Reduction at 650℃

HIGH CR FERRITIC HEAT RESISTANCE STEEL

TECHNICAL FIELD

The present invention relates to heat resisting steel that may be used in those applications that require the heat resistance, and is particularly suited to applications where such heat resisting steel are used as turbine members such as turbine rotors, turbine blades, turbine disks, bolts, or piping, and the like.

BACKGROUND OF THE INVENTION

In the thermal power system, the temperature of steam supplied to the steam turbine is becoming increasingly higher in order to provide the higher electricity production efficiency. Accordingly, the turbine materials must meet the more strict requirements for the high temperature properties. For those years, numerous heat resisting steels have been developed, and have been used to meet such requirements. Some of the heat resisting steels are known as having the good resistance to the comparatively high temperatures, as proposed in Japanese patent applications now published under No. Heisei 4 (1992)-147948 and No. Heisei 8 (1996)-3697, respectively.

For the high Cr (chromium) ferrite-type heat resisting steel, however, it is found that the creep strength that such steels possess will be reduced remarkably, when they are used at 650° C. for a long period of time. To avoid that such reduction in the creep strength occurs at 650° C., the maximum temperature at which the steels can be used is actually limited to less than about 620° C. Therefore, demands arise for turbine materials that can be used at 650° C. for a long period of time, without causing the remarkable reduction in the creep strength.

The present invention is based on the above observations, and it is an object of the present invention to provide novel heat resisting steels that can maintain their good the high temperature properties and permanence properties etc, by controlling the remarkable reduction in the creep strength that may occur when the steels are used at high temperatures, such at least 650° C., for the long period of time.

SUMMARY OF THE INVENTION

The present invention addresses the problems described above. In order to solve those problems, a first aspect of the present invention provides heat resisting steels that may be composed of 0.08 to 0.13% of carbon (C), 8.5 to 10.2% of chromium (Cr), 0 to 1.5% of molybdenum (Mo), 0.10 to 0.25% of vanadium (V), 0.03 to 0.08% of niobium (Nb), 0.2 to 5.0% of tungsten (W), 1.5 to 6.0% of cobalt (Co), 0.005 to 0.015% of boron (B), 0.015 to 0.025% of nitrogen (N), and 0.01 to 3.0% of rhenium (Re), all of which are represented in terms of the percentage by mass, and, for the rest, iron (Fe) and any unavoidable impurities.

A second aspect of the present invention provides heat resisting steels that, in addition to the same components with the same composition ratio as those listed in the first aspect, may include any one or ones of 0.05 to 0.8% of nickel (Ni) and 0.1 to 1.3% of copper (Cu), as represented as the percentage by mass, and, for the rest, iron (Fe) and any unavoidable impurities.

A third aspect of the present invention provides heat resisting steels that may be composed of the same components with the same composition ratio as those listed in any of the heat resisting steels according to the first and second aspects, and, for the rest, iron and any unavoidable impurities, wherein the accelerated creep inhibitor parameter as expressed in terms of 3 [% Cr]+[% Mo]+[% W]−15 [% Re]−31.5, where % represents the mass of each component, is equal to zero (0) or below.

In the following description, the functional action of each of the components contained in the heat resisting steels according to each aspect of the present invention is discussed, and the reason why the values for each component should be restricted to the value range specifically shown above is also explained. Note that the content of each component is represented in terms of the percentage (%) by mass.

C: 0.08 to 0.13

C is an essential element in that it promotes the martensitic transformation, and may be combined with Fe, Cr, Mo, V, Nb, W, etc. in the alloy, resulting in the formation of carbide that increases high temperature strength. With less carbide, the creep strength would be reduced at the high temperatures, and if the carbide is exiguous, the Laves phases that have the intermetallic compound of (Fe, Cr), (Mo, W) become agglomerated into larger grains more quickly. In this regard, it is required that the steel contains at least 0.08% of C. On the other hand, if C content exceeds 0.13%, carbide would become agglomerated into larger grains more quickly, resulting in the reduction in the creep strength at high temperature. For the above reason, the content of C should be limited to the value range of between 0.08 and 0.13%.

Cr: 8.5 to 9.8% (10.2%)

In the present invention, Cr, as well as Re that will be described later, is considered to be one of the most important elements or components. In an effort to find any possible means to control the reduction in the creep strength that occurs when the steel is used at 650° C. for a long period of time, the inventors of the current application have identified the possible causes for the reduction in a creep strength, and have studied its mechanism. Based on the results of the study, the inventors have proposed an accelerated creep inhibitor parameter as an important factor that would contribute to controlling the reduction in the creep strength for a long period of time, and have discovered that this parameter value should desirably be equal to zero (0) or below. This parameter will be described later in further detail.

Among the components that form the accelerated creep inhibitor parameter formula, Re has the largest factor value, and Cr has the next largest factor value. As the feature of the steels according to the present invention, the reduction in the creep strength can be prevented by strictly controlling the amount of Cr to be added. This allows the high creep strength to be maintained when the steel is used at the high temperatures during the extended period of time.

For the ferrite-type heat resisting steel containing 8 to 12% Cr, the concept that generally prevails in the prior art is that the room temperature tensile strength, and the creep strength at above 600° C. under the high stress and during the short time (1000 to 2000 hours) will become higher with the increasing Cr %, and therefore the higher Cr % will be preferred as far as it produces no ferrite. From the results of the long-time creep testing that was conducted in specifics in the neighborhood of 650° C., however, it is discovered that the fine structure of the martensitic steel required for maintaining the creep strength will change remarkably under the creep testing conditions such as high temperature and high stress and the fine martensitic structure is recovered, and is turned into equi-axed crystals in a observation of microscope, when Cr content exceeds 9.8%. It is also discovered that the finely deposited Laves phases disappear, the deposits are agglomerated into larger grains more markedly, and the dislocation density is decreased more markedly. From this study, it is clear that the fine martensitic steel structure becomes softened as a whole, and its creep strength is reduced excessively over the time. As any excessive Cr content will reduce the long-time creep strength remarkably near 650° C., the Cr content should be at most 9.8%.

On the other hand, Cr may increase the anti-oxidation as well as the anti-corrosion at high temperatures. This element may form a solid solution in the inventive alloy, and may also be deposited as the deposited carbide and fine Laves phases, increasing the high temperature creep strength. Thus, Cr content should be at least 8.5% or more. From the above observations, it may be concluded that the Cr content should be limited to at least 8.5% and at most 9.8%. For the same reasons as described above, the preferred upper limit should be less than 9.5%. When Re is added, however, this element may work as the inhibitor that controls the reduction in the creep strength at high temperatures. In this case, Cr upper limit may be 10.2%, more desirably, 10.0%. The most preferred upper limit may be less than 9.5%.

Mo: 0 to 1.5%

Mo is an effective component that works as the inhibitor that prevents carbide from being agglomerated into larger grains. This element may form a solid solution in the inventive alloy, and the solid solution results reinforcement of the matrix. It may also be deposited finely and dispersedly on the matrix as the Laves phases, increasing the high temperature strength and the high temperature creep strength. Mo may be added as required. If Mo is added excessively, however, it might produce delta ferrite more easily, and might cause the Laves phases to become agglomerated into larger grains more quickly. Thus, the upper limit of 1.5% is preferred. In order to allow Mo to perform its functions fully as described above, adding at least 0.02 of Mo is preferred, and for the similar reasons, the lower limit of 0.1% and the upper limit of 0.5% are more preferable.

V: 0.10 to 0.25%

V is an effective component that forms fine carbide and carbon nitride that may increase the high temperature creep strength. Thus, at least 0.10% of V is required. Over 0.25%, however, V may fix carbon excessively, causing more carbide to be deposited. This may reduce the high temperature creep strength. For this reason, V content should be limited to at least 0.10% and at most 0.25%.

Nb: 0.03 to 0.08%

Nb is an effective component that forms fine carbide and carbon nitride that may increase the high temperature creep strength. This element may also help crystalline grains become finer, enhancing the low temperature toughness. Thus, at least 0.03% of Nb is required. Over 0.08%, however, Nb may cause carbide and carbon nitride to be deposited in larger grains, reducing the toughness and ductility. For this reason, Nb content should be limited to at least 0.03% and at most 0.08%.

W: 0.2 to 5.0%

W is an effective component that works as the inhibitor that prevents carbide from being agglomerated into larger grains. This element may form a solid solution in the alloy, and the solid solution resulting reinforcement of the matrix. It may also be deposited finely and dispersedly on the matrix as the Laves phases, increasing the high temperature strength and the high temperature creep strength. At least 0.2% of W is required. Over 5.0% W, however, it may produce delta ferrite more easily, and may also cause Laves phases to be agglomerated into larger grains more quickly. For this reason, W content should be limited to at least 0.2% and at most 5.0%. For the similar reason, the lower limit of 1.2% and the upper limit of 4.0% are preferred. More preferably, the lower limit may be 3.0%.

Co: 1.5 to 6.0%

Co inhibits the production of delta ferrite, and increases the high temperature strength and high temperature creep strength. To inhibit the production of delta ferrite effectively, at least 1.5% of Co is required. Over 6.0%, however, Co may reduce the ductility and high temperature creep strength. This may also increase the cost. For this reason, Co content should be limited to at least 1.5% and at most 6.0%. For the similar reason, the lower limit of 2.5% and the upper limit of 4.5% are preferred.

B: 0.005% to 0.015%

B works as an effective inhibitor that prevents the precipitated carbide, precipitated carbon nitride and precipitated Laves phases within the old austenitic grain boundary, martensitic packets, martensitic brocks and martensitic lath from being agglomerated into larger grains at high temperature during the long period of time. When combined with the alloy elements such as W, Nb and the like, B may increase the high temperature creep strength. A lower limit of 0.005% B is preferred. Over 0.015%, however, B may be combined with nitrogen, forming the precipitated BN phase that may reduce the high temperature creep ductility and toughness. For this reason, B content should be limited to above 0.005% and at most 0.015%. A lower limit of 0.005% and an upper limit of 0.010% are preferred.

N: 0.015 to 0.025%

When combined with Nb, V and the like, N may form nitride, increasing the high temperature strength and high temperature creep strength. Below 0.015%, N may not provide the sufficient temperature strength and high temperature creep strength. Over 0.025%, N may be combined with boron, forming the deposited BN phase which reduces the effect of B. This may reduce the high temperature ductility and toughness. For this reason, N content should be at least 0.015% and at most 0.025%.

Re: 0.01 to 3.0%

According to the present invention, Re, as well as Cr described earlier, is considered to be one of the important elements. By adding a slight amount of Re (0.01% or more), it may results solution reinforcement remarkably. Re has the concentration in the matrix that remains almost unchanged even at the high temperatures, and may increase the stability of the matrix structure when it is placed at the high temperature during the extended period of time. This element may also increase the high temperature creep strength as well as the toughness. If added, Re may have the inhibitor action to prevent the remarkable reduction in the long-time creep strength in the neighborhood of 650° C. Thus, Re may be added if required. By considering that Re is an expensive metal and that, if added excessively, it may affect the workability; its upper limit should be 3.0%. In order to allow Re to provide its functions described above, Re content should preferably be at least 0.1%. For the similar reasons, it is more preferable that Re should at least 0.2% and at most 1.0%.

Ni: 0.05 to 0.8%

Like Mn, Ni is an element that stabilizes the austenite, and contributes to enhance toughness. It may be added as required. Below 0.05%, it does not provide the above action, and above 0.8%, it may cause carbides and Laves phases to be agglomerated into larger grains, reducing the high temperature creep strength. Thus, the preferred Ni content should be at least 0.05% and at most 0.8%. More preferably, it should be at least 0.1%, and at most 0.5%. For the upper limit, it should be at most 0.3%

Cu: 0.1 to 1.3%

Like Mn and Ni, Cu is an element that stabilizes the austenite, and may contribute the enhancing toughness. It may be added as required. Below 0.1%, this element does not provide this action, and above 1.3%, it may reduce the high temperature creep strength, and may reduce the hot workability. Thus, the preferred Cu content should be at least 0.1% and at most 1.3%. More preferably, it should be at least 0.3% and at most 0.8%.

Accelerated Creep Inhibitor Parameter

The creep strength testing was conducted to examine the creep strength for the steels of the present invention that were placed in the neighborhood of 650° C. The creep strain rate—time curve obtained from this testing shows that the time at which the creep strain rate is beginning to accelerate discontinuously is shifted toward the longer time zone. By shifting toward the longer time zone, it is possible to control the remarkable reduction in the creep strength, which is the feature of the present invention. The time at which the creep strain rate is beginning to accelerate depends largely upon the components of a particular material, and it is discovered that above-mentioned may be clarified by using the formula given below, and calculating this formula on the content of each of the components. For the purpose of convenience, the inventors have named this formula as the 'accelerated creep inhibitor parameter'. If the value that results from calculating the formula is more than zero (0), it means that the agglomeration of the Laves phases deposited in the matrix cannot be inhibited, and the time at which the creep strain rate is beginning to accelerate discontinuously is shifted toward the shorter time zone. Thus, the components may be preferably designed so that this parameter can be equal to zero (0) or below. By so designing, the time at which the creep strain rate is beginning to accelerate discontinuously may be about 50,000 hours or more. More preferably, the value that will result from the following formula should be equal to −2 or below. Specifically, this accelerated creep inhibitor parameter is given below:

$$3[\%\ Cr]+[\%\ Mo]+[\%\ W]-15[\%\ Re]-31.5$$

DETAILED DESCRIPTION OF THE INVENTION

According to the present invention, the heat resisting steel may be obtained by using any of the usual dissolving methods that are known in the art. It should be understood that the present invention is not limited to any particular dissolving method.

The heat resisting steel thus obtained may be worked such as forging, or may be done heat treatment under the desired conditions.

Quenching Process

In the heat resisting steel according to the present invention, the high temperature creep strength may be improved by allowing the deposited carbon nitride to form the solid solution during heating in the quenching process, and then by allowing the carbon nitride to be deposited uniformly, finely and dispersedly during the subsequent tempering process. As the heat resisting steel contain boron, the temperature at which the deposited carbide and carbon nitride form the solid solution may be shifted toward the higher temperature zone. When the temperature at which the hot quenching process occurs is below 1060° C., the solid solution formed by the deposits would become insufficient. Thus, the desired creep strength would not be obtained. Above 1120° C., however, the crystalline grains would become larger, reducing the toughness as well as the creep ductility. Thus, the preferred temperature range should be at least 1060° C. and at most 1120° C. It should be noted that the cooling during the quenching process may be done at the cooling rate above the air cooling. The cooling rate and the coolant may be selected as appropriate.

Tempering Process

During the tempering process, the retained austenite produced during the preceding quenching process may be dissolved into the tempered martensitic monophase structure, and carbide, carbon nitride and Laves phases may be deposited uniformly, finely and dispersedly on the resulting matrix and the dislocation may be recovered. The desirable room temperature strength, high temperature strength, toughness and high temperature creep strength may be provided in the tempering process. The tempering process should preferably occur two or more times, and the first tempering process should preferably occur at the heating temperature above the Ms temperature to allow the retained austenite to be dissolved. If the tempering process occurs at any temperature below 500° C., the residual austenite would not be dissolved sufficiently. If the tempering process occurs at any temperature above 620° C., the deposition of the carbide, carbon nitride and Laves phases in the martensitic structure would occur first, and the carbide, carbon nitride and Laves phases in the retained austenite would be deposited non-uniformly. This would affect the high temperature creep strength, which would be reduced. For this reason, the temperature at which the first tempering process occurs should preferably range between 500° C. and 620° C. During the second tempering process, the ductility and toughness may be improved, and the deposits may be stabilized so that the long time high temperature creep strength can be provided. To this end, the second tempering process should preferably occur at any temperature above 690° C. It should be noted, however, that above 740° C., the desired room temperature strength and high temperature strength could not be obtained. For this reason, the temperature at which the second tempering process occurs should preferably range between 690° C. and 740° C.

EFFECTS OF THE INVENTION

The heat resisting steel according to the present invention provides the advantage of increasing the long time creep strength, and may be used in those applications in which turbine rotors or other turbine members made of such heat resisting steel are required in the thermal power plant or system. Using the heat resisting steel in those applications, for example, allows the steam temperature to become higher, increasing the power production efficiency in the thermal power plant or system. The present invention may be used in other applications where the high temperature operation and durability are required.

By setting the accelerated creep inhibitor parameter as expressed in terms of 3 [% Cr]+[% Mo]+[% W]−15 [% Re]−31.5 to equal to zero (0) or below within the component range defined in the present invention, the high creep strength may be shifted toward the longer time zone, and may be maintained for the extended period of time.

Figure 1:
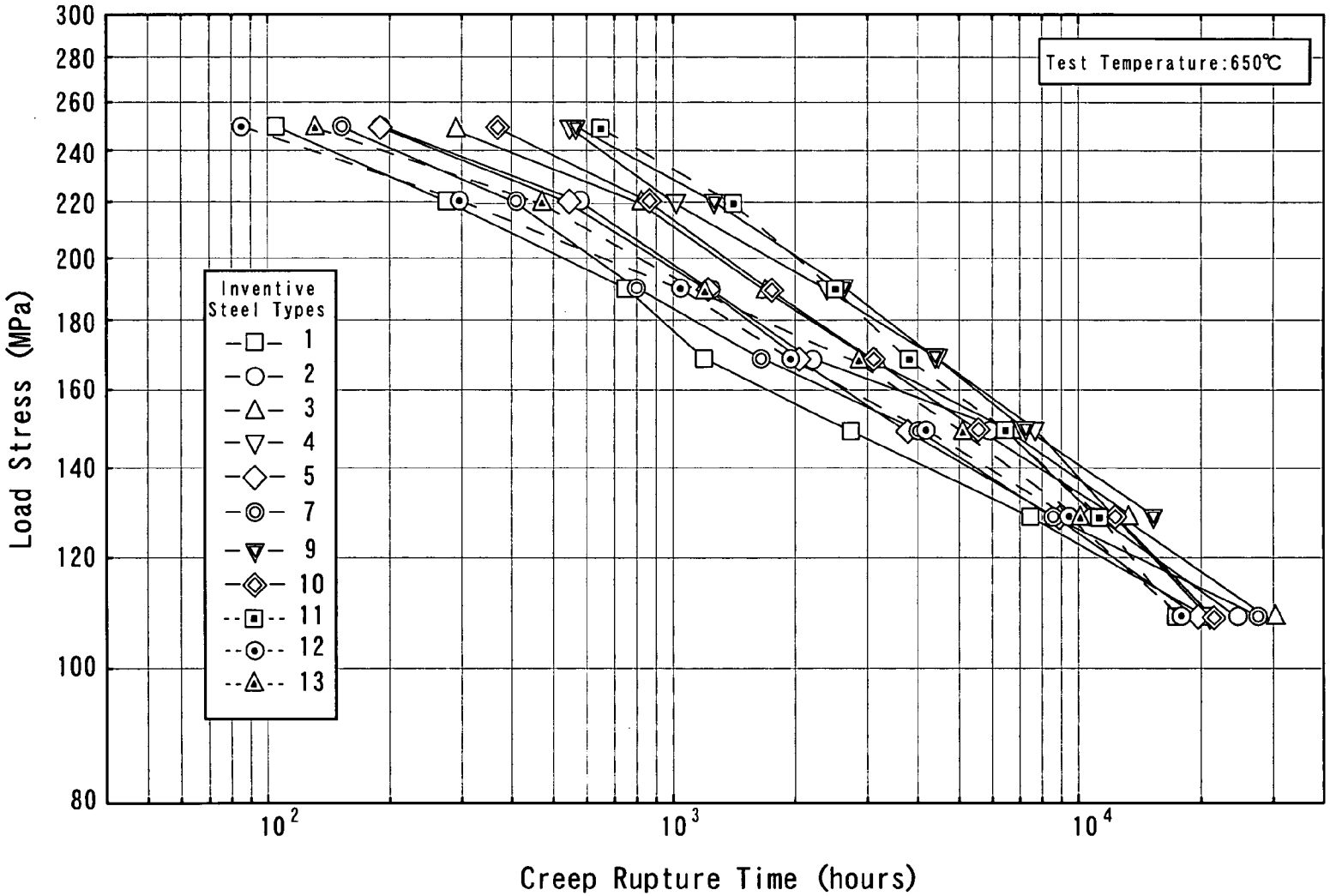
FIG. 1 is a graph representation of the relationship between the creep stress and the time at which creep rupture occurs, for some steels according to one embodiment of the present invention.

For each category, different types of samples are first provided. Those samples are obtained by processing different types of alloys in the following manner, each having the composition (including, for the rest, Fe and unavoidable impurities) given by steel type in each category in Table 1. Each of the alloys is dissolved, and 50 kg of steel ingot is thus obtained. The ingots are then forged, after which the hot treatment occurs as required. The hot treatment begins at 1070° C., followed by the oil-cooled quenching treatment. After then, the first tempering processing occurs at 570° C., and the second tempering processing then occurs at 700° C.

TABLE 1

| | | Chemical Components (mass %) | | | | | | | | | | | | | | Accelerated |
|---|---|---|---|---|---|---|---|---|---|---|---|---|---|---|---|---|
| | | Alloy Components | | | | | | | | | Selected Components | | | | | Creep Inhibit |
| Sample No. | | C | Cr | Mo | V | Nb | W | Co | B | N | Re | Si | Mn | Ni | Cu | Parameter |
| Inventive Steels | 1 | 0.11 | 8.57 | 0.10 | 0.16 | 0.07 | 3.46 | 2.89 | 0.008 | 0.021 | — | — | — | 0.21 | — | −2.23 |
| | 2 | 0.12 | 8.96 | 0.11 | 0.16 | 0.06 | 3.46 | 2.88 | 0.008 | 0.020 | — | — | — | 0.21 | — | −1.05 |
| | 3 | 0.11 | 9.34 | 0.04 | 0.16 | 0.06 | 3.41 | 2.86 | 0.009 | 0.020 | — | — | — | 0.21 | — | −0.03 |
| | 4 | 0.11 | 9.77 | 0.10 | 0.16 | 0.06 | 3.88 | 2.88 | 0.008 | 0.020 | — | — | — | 0.20 | — | 1.79 |
| | 5 | 0.12 | 9.02 | 0.08 | 0.16 | 0.06 | 3.91 | 2.82 | 0.008 | 0.021 | 0.23 | — | — | 0.20 | — | −3.90 |
| | 7 | 0.12 | 8.97 | 0.14 | 0.18 | 0.06 | 3.60 | 2.60 | 0.007 | 0.017 | 0.20 | — | — | 0.05 | 0.43 | −3.85 |
| | 9 | 0.09 | 9.81 | 0.15 | 0.18 | 0.06 | 3.70 | 5.26 | 0.008 | 0.019 | 2.24 | — | — | 0.14 | — | −31.82 |
| | 10 | 0.11 | 9.40 | 0.49 | 0.20 | 0.06 | 4.02 | 4.04 | 0.009 | 0.022 | — | — | — | 0.20 | — | 1.21 |
| | 11 | 0.13 | 9.75 | 0.10 | 0.19 | 0.05 | 4.27 | 2.61 | 0.013 | 0.018 | — | — | — | 0.01 | — | 2.12 |
| | 12 | 0.12 | 9.74 | 0.70 | 0.20 | 0.06 | 1.80 | 3.00 | 0.007 | 0.016 | 0.20 | — | — | 0.25 | — | −2.78 |
| | 13 | 0.12 | 9.78 | 0.16 | 0.20 | 0.06 | 2.77 | 2.66 | 0.007 | 0.017 | 0.21 | — | — | 0.25 | — | −2.38 |
| Non-Inventive Steels | 21 | 0.12 | 10.53 | 0.10 | 0.15 | 0.06 | 3.46 | 3.00 | 0.008 | 0.019 | — | — | — | 0.20 | — | 3.65 |
| | 22 | 0.12 | 11.37 | 0.10 | 0.15 | 0.06 | 3.40 | 3.05 | 0.010 | 0.020 | — | — | — | 0.22 | — | 6.11 |
| | 23 | 0.11 | 10.55 | 0.12 | 0.20 | 0.06 | 5.40 | 5.49 | 0.008 | 0.018 | — | — | — | 0.18 | — | 5.67 |
| | 24 | 0.10 | 11.99 | 0.10 | 0.15 | 0.06 | 3.50 | 9.02 | 0.009 | 0.017 | — | — | — | 0.20 | — | 8.07 |
| | 25 | 0.06 | 10.06 | 0.48 | 0.15 | 0.04 | 3.84 | 3.03 | 0.008 | 0.021 | — | — | — | 1.11 | — | 3.00 |
| | 26 | 0.06 | 10.33 | 0.81 | 0.15 | 0.04 | 4.26 | 4.96 | 0.008 | 0.018 | — | — | — | 0.55 | — | 4.56 |
| | 27 | 0.11 | 7.58 | 0.10 | 0.16 | 0.06 | 3.45 | 2.85 | 0.007 | 0.023 | — | — | — | 0.20 | — | −5.21 |
| | 28 | 0.11 | 8.01 | 0.69 | 0.16 | 0.06 | 1.88 | 2.85 | 0.003 | 0.053 | — | — | — | 0.20 | — | −4.90 |

Accelerated Creep Inhibit Parameter: 3 [% Cr] + [% Mo] + [% W] −15 [% Re] −31.5

Figure 5:
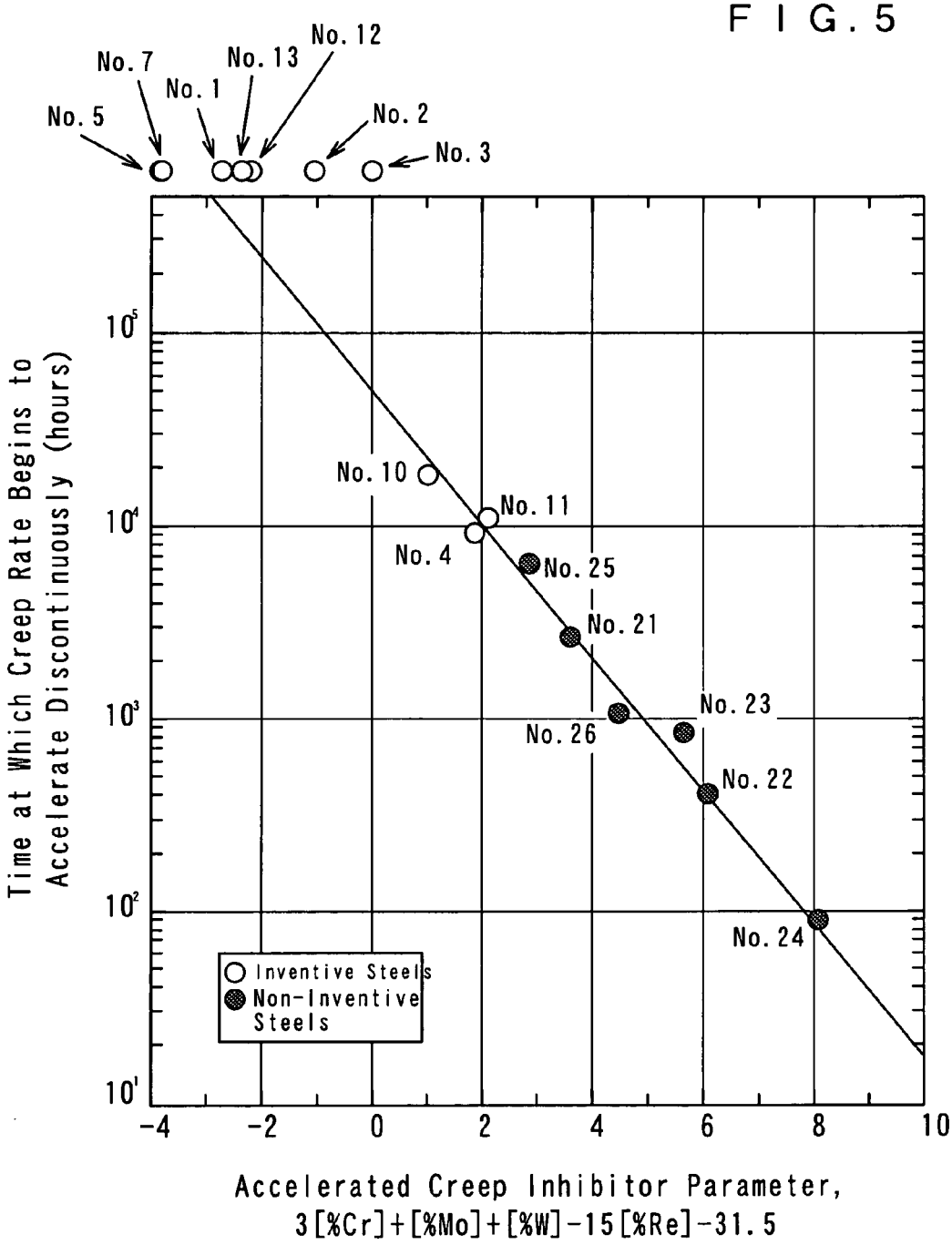
Figure 6:
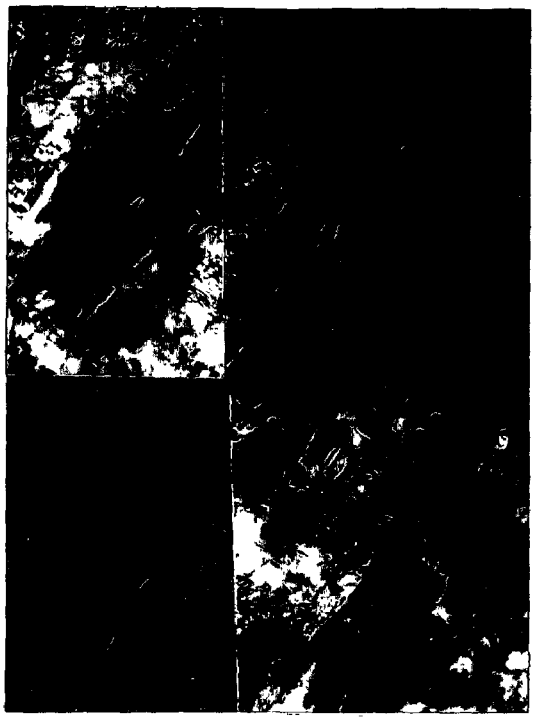
Figure 6:
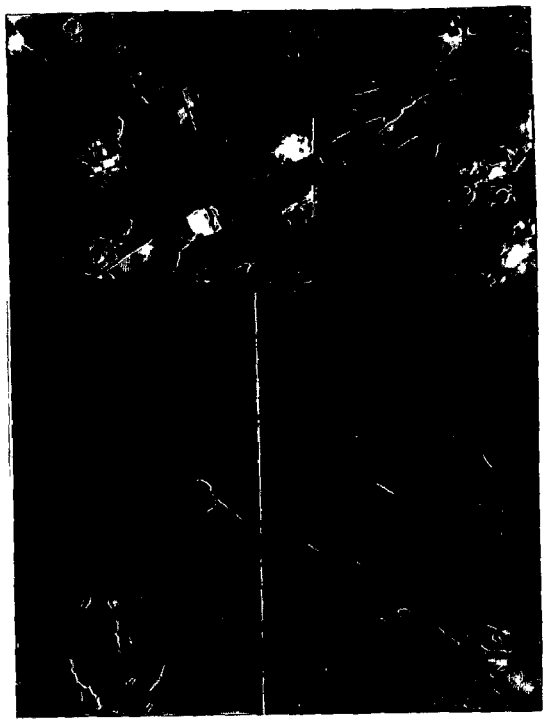
Figure 7:
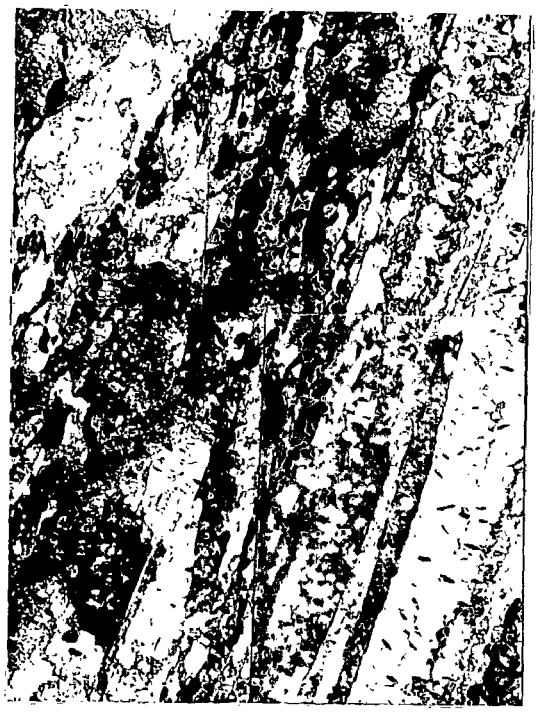
Figure 7:
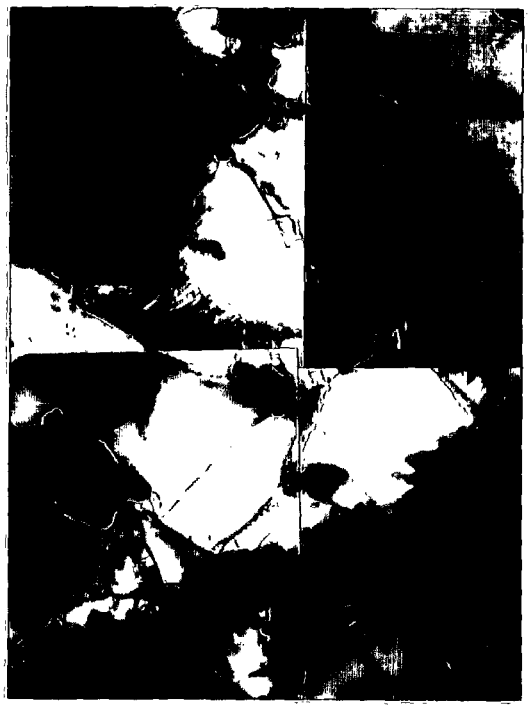
Figure 8:
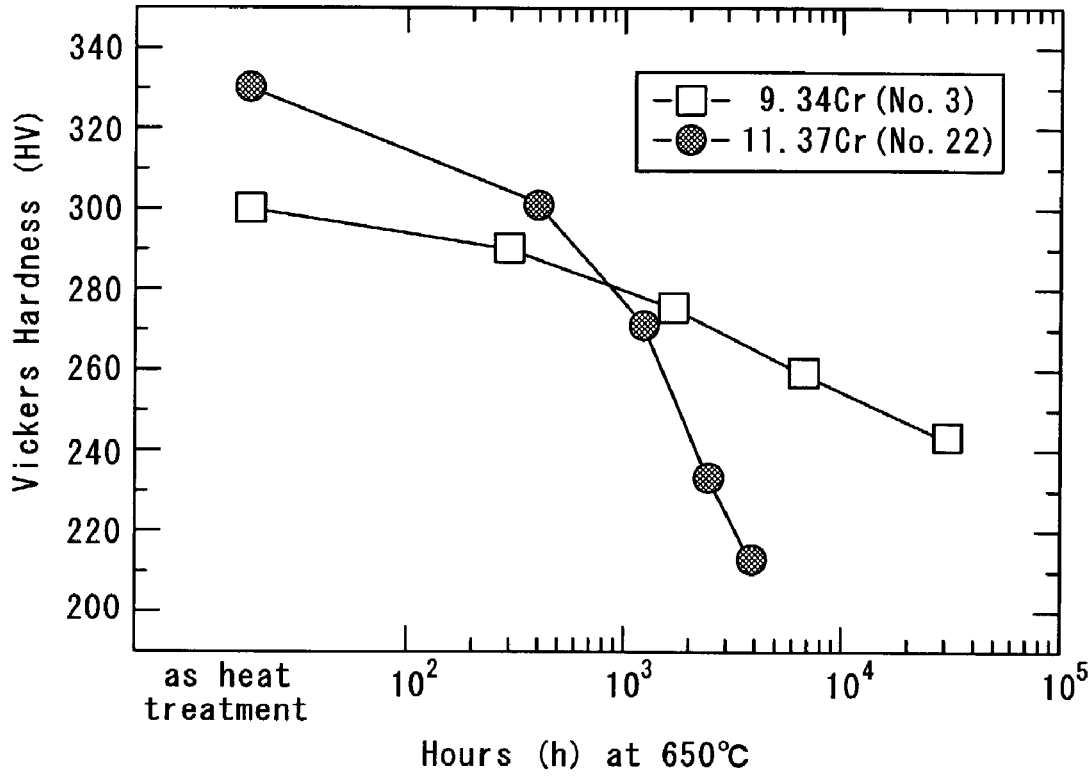

FIG. 5 is a graph representation of the relationship between the accelerated creep inhibitor parameter and the time during which the creep rate is beginning to accelerate discontinuously;

FIG. 6 is microscopic photographs of the structures for some samples observed through the transmission electron microscope when they remain as heat treatment and after the creep testing occurred, respectively;

FIG. 7 is microscopic photographs of the structures for other samples observed through the transmission electron microscope when they remain as heat treatment and after the creep testing occurred, respectively; and FIG. 8 is a graph representation of changes in the hardness for some samples that occur when they are maintained at 650° C.

EXAMPLES

The present invention will now be described more specifically by presenting two different categories of heat resisting steel that are used to compare with each other.

In the following description, the first category of heat resisting steel is referred to as the 'inventive steels' that may be obtained in accordance with the embodiment described so far, and the second category of heat resisting steel is referred to as the 'non-inventive steels' that are used to compare with the inventive steels.

For each of the samples thus obtained, the creep testing and the creep rupture testing occur at 650° C., respectively. Each of the test results is checked for the creep strength. The results are given in FIGS. 1 and 2.

Figure 2:
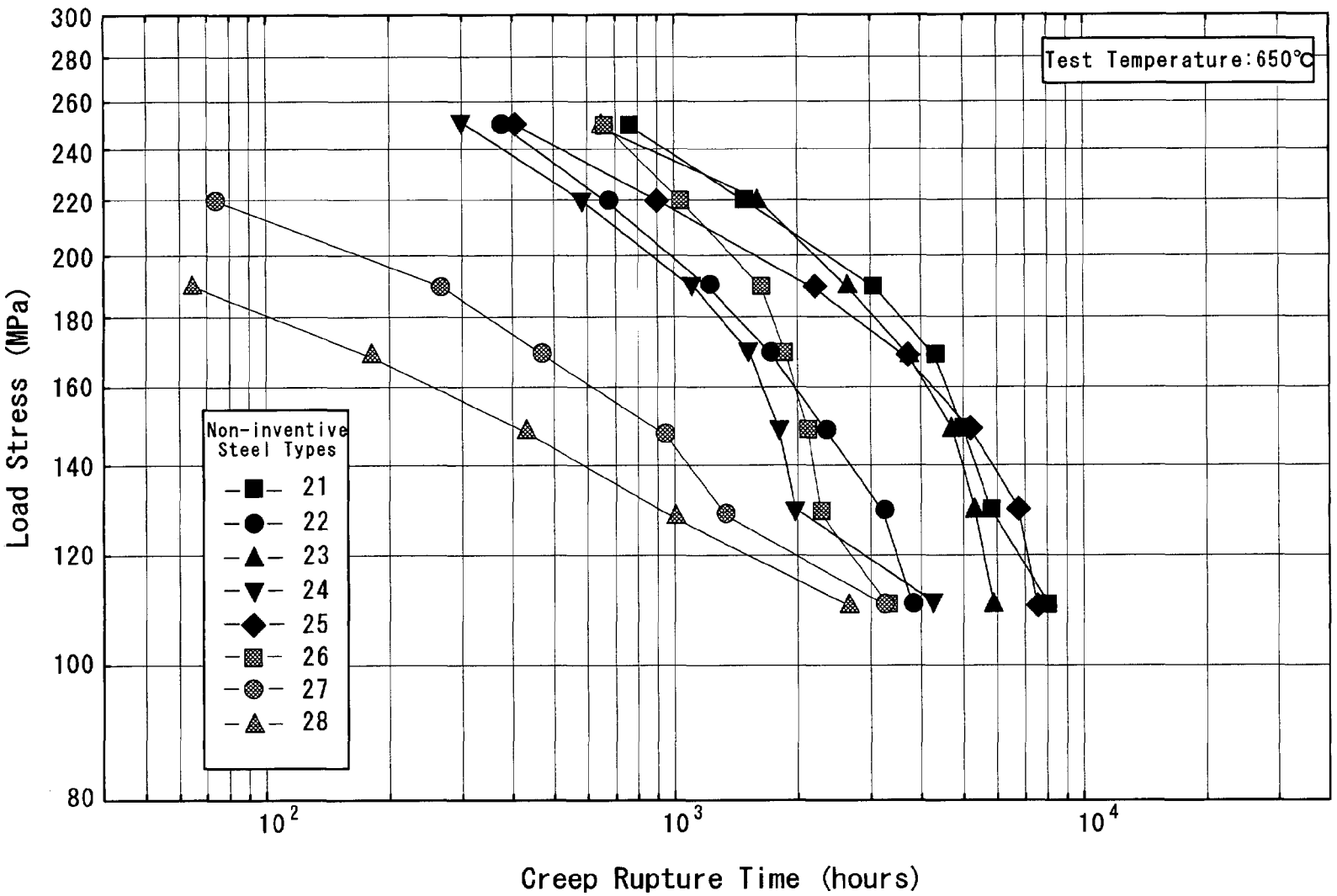
FIG. 2 is a graph representation showing the relationship between the creep stress and the time at which creep rupture occurs, for other steels according to another embodiment of the present invention that are to be compared with the steels of FIG. 1.

It may be appreciated from FIGS. 1 and 2 that for the inventive steel category, each sample retains the high creep strength after the long-time creep testing occurred, with the creep stress—rupture time curve showing a slow slope, and can maintain the high creep strength for the extended period of time.

Figure 3:
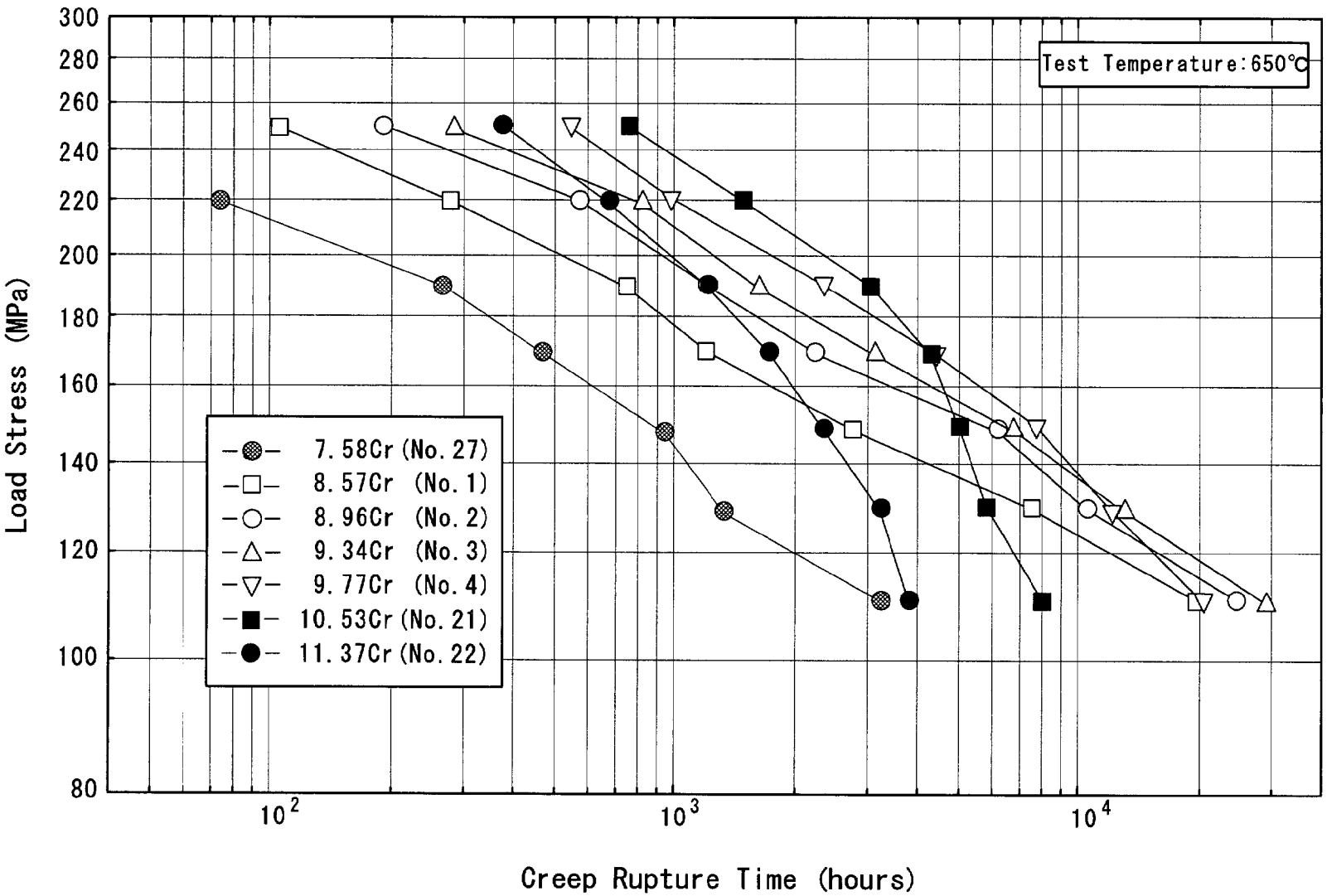
FIG. 3 is a graph representation of the relationship between the creep stress and the time at which creep rupture occurs, based on changes in Cr content.

In the accelerated creep inhibitor parameter, it is particularly important to control the coefficients involved, and Cr content that is relatively large. FIG. 3 shows the creep stress—time curve for Cr that changes over time, from which it may be appreciated that if Cr content is too low (for the non-inventive steel type No. 27), the creep strength becomes lower, while Cr content is too high (for the non-inventive steel types No. 21, 22), the short time creep strength may be high, but the creep strength becomes lower when shifted toward the longer time zone.

Figure 4:
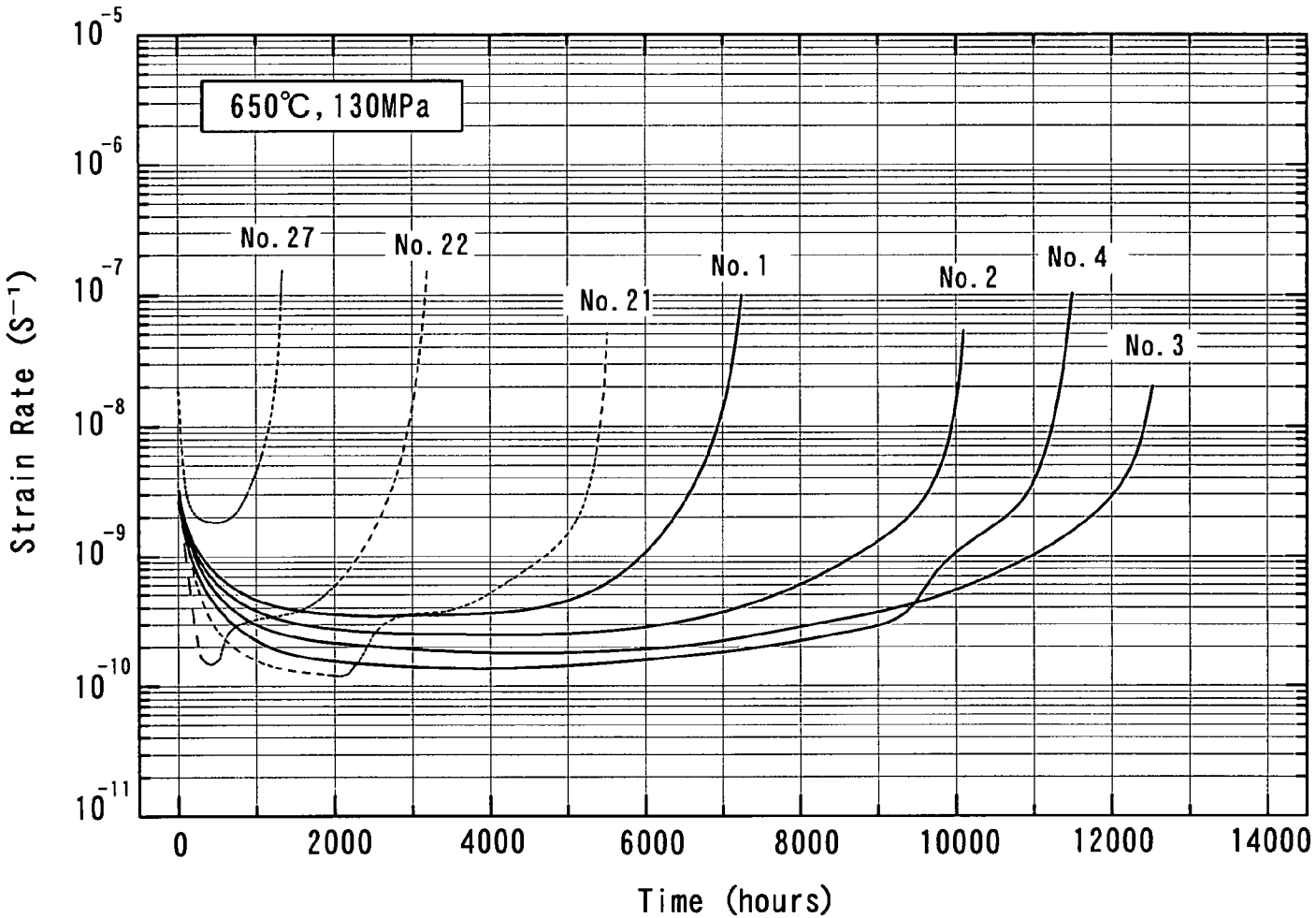
FIG. 4 is a graph representation of the relationship between the creep strain rate and the time during which the testing occurs.

FIG. 4 shows the creep strain rate—time curve for the steel types No. 1, 2, 3 and No. 4 in the inventive steel category and for the steel types No. 21, 22, and No. 27 in the non-inventive steel category, all of which are placed at 650° C. It may be seen from FIG. 4 that for the steel types No. 21 and No. 22, the creep strain rate accelerates discontinuously on the way of the creep deformation, while for the steel types No. 1, 2 and No. 4, the creep strain rate changes continuously from the time at which the initial creep occurs until the time at which the creep rupture occurs. For the steel type No. 4, it may be seen that the creep rate accelerates discontinuously at the point of 9500 hours, which is shifted toward the longer time zone as compared with the non-inventive steel types. The curve shown in FIG. 4 corresponds to the results of the testing that occurred under the creep conditions of 650° C. and 130 MPa, but when the creep testing occurs under the lower stress conditions, it is noticed that the creep strain rate may also accelerate discontinuously for the inventive steel types. For the non-inventive steel types, for which the time at which the discontinuous acceleration begins to occur is shifted toward the shorter time zone, the creep rupture occurs very shortly, as compared with the inventive steel types, for which the time at which the discontinuous acceleration begins to occur is shifted toward the longer time zone. For the non-inventive steel types No. 27 and 28, the accelerated creep inhibitor parameter is low, and the discontinuous acceleration may not be noticed, but the creep strength is totally low as compared with the inventive steel types.

As described above, the accelerated creep inhibitor parameter may be used to identify the steel types for which the discontinuous creep strain rate acceleration is not noticeable and that can maintain the high creep strength for the extended period of time. FIG. 5 shows the relationship between the accelerated creep inhibitor parameter and the time at which the discontinuous creep strain rate acceleration is beginning to appear, which was obtained when the creep testing occurred at 650° C. It may be seen from FIG. 5 that the discontinuous creep strain rate acceleration is beginning to occur in the shorter time zone as the accelerated creep inhibitor parameter is larger, and the high temperature creep strength cannot be extended to the longer time zone. It may also be seen, on the contrary, that as the accelerated creep inhibitor parameter is smaller, the discontinuous creep strain rate acceleration is not noticeable until it reaches the longer time zone, and the high temperature creep strength can be extended to the longer time zone.

In FIG. 5, the data that appears on the upper left corner of the graph pertains to eight (8) inventive steel types, for which the discontinuous creep rate acceleration was not noticed until it reached 33,000 hours during the creep testing.

FIGS. 6 and 7 are microscopic photographs for the inventive steel type No. 3 and the non-inventive steel type No. 22, respectively, which show the microstructures of the parallel regions observed through the transmission electron microscope when those steel types are occurred the creep testing under the conditions of 650° C. and 150 MPa or they are as heat treatment. Specifically, the photograph 1(*a*) in FIG. 6 shows the microstructure for the steel type No. 3 before the creep occurred, from which the fine martensitic lath structure and the fine deposits ($M_{23}$ $C_6$, Laves phases, MX) were observed. The photograph 1(*b*) in FIG. 6 shows the microstructure for the parallel region of the steel type No. 3, after the creep rupture occurred on its sample (6674 hours). It is observed from this microstructure that the fine martensitic structure is maintained, with the finely deposited Laves phases within the lath also remaining, and the reduction in the dislocation is less.

On the other hand, the photograph 2(*a*) in FIG. 7 shows the microstructure for the non-inventive steel type No. 22 before the occurrence of the creep. Like the steel type No. 3, the fine martensitic lath structure is observed for the steel type No. 22. The photograph 2 (*b*) in FIG. 7 shows the microstructure for the steel type No. 22 after the creep rupture occurred (2402 hours). Although the creep testing occurred on the steel type No. 22 under the same creep conditions as the steel type No. 3, this microstructure corresponds to the microstructure for the sample for which the creep rupture occurred in a very short time such as 2402 hours. It is observed from the microstructure that the fine martensitic structure is recovered, and is turned into the equi-axed crystals. It is also that the finely deposited Laves phases disappear, with the deposits being agglomerated into larger grains more quickly. The remarkable reduction in the dislocation density is also observed.

FIG. 8 represents a graph that shows how the hardness is decreasing while the inventive steel type No. 3 and the non-inventive steel type No. 22 are maintained at 650° C. The hardness was measured at the threaded portions of the respective samples being tested for the creep. It may be seen from FIG. 8 that the steel type No. 22 exhibits the remarkable reduction in the hardness, as compared with the steel type No. 3. What causes such reduction can be explained by observing the microstructure described above. Any change in the microstructure that may cause the reduction in the hardness may also have the effect on the long time creep strength. As it may be appreciated from FIG. 3 that any change in the Cr content may have the effect on the behavior manifested by the creep, it may also be appreciated that any change in the Cr content may affect the long-time creep strength, particularly if it is too high.

The invention claimed is:

1. High Cr ferritic heat resisting steel composition having an enhanced high temperature creep strength consisting of 0.08 to 0.13% of carbon (C), 8.5 to a maximum of 9.81% of chromium (Cr), 0 to 1.5% of molybdenum (Mo), 0.10 to 0.25% of vanadium (V), 0.03 to 0.08% of niobium (Nb), 0.2 to 5.0% of tungsten (W), 1.5 to 6.0% of cobalt (Co), 0.005 to 0.015% of boron (B), 0.015 to 0.025% of nitrogen (N), and 0.01 to 3.0% of rhenium (Re), all represented in terms of the percentage by mass with the remainder iron (Fe) and any unavoidable impurities.

2. High Cr ferritic heat resisting steel composition having an enhanced high temperature creep strength consisting of 0.08 to 0.13% of carbon (C), 8.5 to a maximum of 9.81% of chromium (Cr), 0 to 1.5% of molybdenum (Mo), 0.10 to 0.25% of vanadium (V), 0.03 to 0.08% of niobium (Nb), 0.2 to 5.0% of tungsten (W), 1.5 to 6.0% of cobalt (Co), 0.005 to 0.015% of boron (B), 0.015 to 0.025% of nitrogen (N), 0.01 to 3.0% of rhenium (Re), and one or more components selected from the group consisting of 0.05 to 0.8% of nickel (Ni), and 0.1 to 1.3% of copper (Cu), all represented in terms of the percentage by mass with the remainder iron (Fe) and any unavoidable impurities.

3. High Cr ferritic heat resisting steel as defined in claim 1, wherein for each respective composition ratio of the components, the accelerated creep inhibitor parameter as expressed in terms of 3[% Cr]+[% Mo]+[% W]−15[% Re]−31.5(% in the bracket represents the percentage of each component by mass) being equal to or no greater than zero (0).

4. High Cr ferritic heat resisting steel as defined in claim 2 wherein for each respective composition ratio of the components, the accelerated creep inhibitor parameter as expressed in terms of 3[% Cr]+[% Mo]+[% W]−15[% Re]−31.5(% in the bracket represents the percentage of each component by mass) being equal to or no greater than zero (0).

* * * * *